United States Patent [19]

DeLuca

[11] Patent Number: 4,804,292

[45] Date of Patent: Feb. 14, 1989

[54] EXPANSION JOINT ASSEMBLY AND METHOD

[76] Inventor: Rocco A. DeLuca, 105 Toledo Ave., Pawtucket, R.I. 02860

[21] Appl. No.: 173,240

[22] Filed: Mar. 24, 1988

[51] Int. Cl.[4] ..... E01C 11/00

[52] U.S. Cl. ..... 404/69; 404/47; 52/573

[58] Field of Search ..... 52/13, 14, 16, 97, 395, 52/396, 573, 464, 310; 404/47, 69; 277/53, 55, 56

[56] References Cited

U.S. PATENT DOCUMENTS

| | | | |
|---|---|---|---|
| 1,357,713 | 11/1920 | Lane | 404/69 X |
| 2,157,290 | 5/1939 | Henderson | 52/303 X |
| 2,935,865 | 5/1960 | Munro | 52/303 |
| 2,945,730 | 7/1960 | Murray et al. | 277/56 X |
| 2,948,994 | 8/1960 | Thom | 52/573 X |
| 3,293,810 | 12/1966 | Cox et al. | 52/303 |
| 3,677,145 | 7/1973 | Wattiez | 404/47 |
| 3,750,359 | 8/1973 | Balzer et al. | 52/468 |
| 3,797,188 | 3/1974 | Mansfeld | 52/396 |
| 4,111,584 | 9/1978 | Fyfe | 404/69 |
| 4,140,419 | 2/1979 | Puccio | 404/69 |
| 4,271,650 | 6/1981 | Lynn-Jones | 52/395 |
| 4,295,315 | 10/1981 | Lynn-Jones et al. | 52/573 |

FOREIGN PATENT DOCUMENTS

| | | | |
|---|---|---|---|
| 2306963 | 8/1974 | Fed. Rep. of Germany | 52/573 |
| 3015011 | 10/1981 | Fed. Rep. of Germany | 404/69 |
| 2524517 | 10/1983 | France | 52/573 |

*Primary Examiner*—David A. Scherbel
*Assistant Examiner*—Andrew Joseph Rudy
*Attorney, Agent, or Firm*—Kenneth P. Glynn

[57] ABSTRACT

The present invention specifically describes an expansion joint assembly for roadways, bridges, parking lot garages and the like which comprises: (a) a first road section terminating with a vertical face having a metal armor upper section and a concrete lower section; (b) a second road section contiguous to said first road section and having a vertical face which is directly opposite the vertical face of said first road section, said second road section vertical face also having a metal armor upper section and having a lower section; (c) a water deflector plate connected to the vertical face of either said first road section or said second road section, said deflector plate having a connecting surface which is anchored to said vertical face and having a deflecting surface which tapers outwardly and downwardly from said vertical face without contacting the other vertical face of said first and second road sections; (d) a water collector plate connected to the vertical face of the other of said first and second road sections, said water collector plate having a connecting surface which is anchored to said vertical face and having an inner collecting surface and an outer collecting surface, the inner collecting surface running from said connecting surface outwardly and downwardly to said outer collecting surface, said outer collecting surface running from said inner collecting surface outwardly and upwardly and terminating below and deflector plate and under it without contacting said deflector plate or the vertical face to which it is connected; (e) anchoring means connecting said deflector plate to said vertical face; and (f) anchoring means connecting said collecting plate to said vertical face.

17 Claims, 3 Drawing Sheets

EXPANSION JOINT ASSEMBLY AND METHOD

BACKGROUND OF THE INVENTION

1. Field of the Invention

The present invention is directed to expansion joint assemblies and methods of making these and is more particularly directed to such expansion joint assemblies as are improved to substantially reduce erosion and other detrimental effects of rain water and other fluid roadway runoff. The invention is directed to the protection of concrete, metal and other materials of a joint in a roadway, bridgeway, parking garage or the like and to the orderly removal of rain, acid rain and other fluid materials.

2. Prior Art Statement

Numerous patents have issued over the years to various types of expansion joints for roadway sections, deck structures for highway bridges, parking lots or the like. The basic prior art arrangement involves spanning an expansion gap with some form of elastomeric material or combination of such material with metal pieces to allow for thermal expansion and contraction of the adjoining sections of roadway or the like. Some prior art arrangements involve elastomeric units of oval or heart shaped or ringlet type designs so as to create increased strength but to still permit reasonable expansion and contraction. However, over the years, many efforts have been made to prevent water, acid rain and other fluids which run off roadway surfaces and bridgeways down through the expansion joints and frequently create corrosion problems or other types of deterioration problems for the underlying concrete.

A number of patents, including U.S. Pat. Nos. 4,271,650; 4,295,315; 3,750,359 and 3,677,145 are directed to various types of expansion joints and specifically disclose the use of a V-shaped or U-shaped channel which is formed in the base and is connected to both sides of the roadway or bridgeway joint. This channel is typically made of flexible or semi-flexible material and is designed to widen or close depending upon the expansion or contraction of the joint. However, all of these channel type run off arrangements involve the use of specifically designed and custom arranged armor or metal plate sections for the roadway which are adapted to receive these channels and, for that reason, these channels are not retrofitable to existing expansion joints. Further, due to the fact that they are connected to both sides of an expansion joint, while they may work well for perfect expansion and contraction, they may undergo serious stresses and fracture or rip when the roadway sections shift asymmetrically, or move out of perfect parallelism, or hinge either in the vertical central axis or move to create a hinge effect in the horizontal plane. In other words, real world expansion joints may frequently be exposed to complex angle expansions and this may create permanent damage to drainage channels which are taught in the prior art. Additionally, the U-shaped and V-shaped channels will collect a buildup of debris and ice which cannot be exposed to upwardly moving hot air which would aid in thawing any built up icing.

The present invention is directed to an expansion joint assembly which allows for rain, water and other fluid runoff and thereby protects expansion joint materials while also overcoming the problems inherent in the U-shape and V-shape channel type systems of the prior art. Thus, the present invention is directed to an expansion joint assembly and method which may be applied to structures already in place as well as to newly created structures and the retrofitting features make the present invention assembly much more universal than those taught in the prior art. Additionally, the present invention assembly allows for movement of warm air upwardly to reduce freezing and ice damage as well as clogging and may be custom arranged to suit the particular geometry of a given expansion joint.

BRIEF SUMMARY OF THE INVENTION

The present invention specifically describes an expansion joint assembly for roadways, bridges, parking lot garages and the like which comprises: (a) a first road section terminating with a vertical face having a metal armor upper section and a concrete lower section; (b) a second road section contiguous to said first road section and having a vertical face which is directly opposite the vertical face of said first road section, said second road section vertical face also having a metal armor upper section and having a lower section; (c) a water deflector plate connected to the vertical face of either said first road section or said second road section, said deflector plate having a connecting surface which is anchored to said vertical face and having a deflecting surface which tapers outwardly and downwardly from said vertical face without contacting the other vertical face of said first and second road sections; (d) a water collector plate connected to the vertical face of the other of said first and second road sections, said water collector plate having a connecting surface which is anchored to said vertical face and having an inner collecting surface and an outer collecting surface, the inner collecting surface running from said connecting surface outwardly and downwardly to said outer collecting surface, said outer collecting surface running from said inner collecting surface outwardly and upwardly and terminating below said deflector plate and under it without contacting said deflector plate or the vertical face to which it is connected; (e) anchoring means connecting said deflector plate to said vertical face; and (f) anchoring means connecting said collecting plate to said vertical face.

SUMMARY OF THE DRAWINGS

The present invention will be more fully understood and appreciated when the specification is taken in conjunction with the attached drawings, in which.

DETAILED DISCRIPTION OF THE PRESENT INVENTION AND DRAWINGS

As mentioned, the present invention is directed to an expansion joint assembly and method of making a custom expansion joint assembly whereby water and other fluid seeping through the expansion joint is directed away from concrete and metal to prevent deterioration or erosion. Further, the present invention overcomes prior art problems by requiring two components rather than a single component to achieve the objective and, in addition, avoids problems such as icing and thawing which occur with the prior art drainage arrangements. Last, the present invention assembly is retrofitable to existing expansion joints as well as includable during the construction of new expansion joints and is able to maintain its structural integrity and withstand unusual rotations, vibrations, torquing and other twisting which may occur between adjacent road sections which may cause fracturing or breakage for the prior art systems.

Figure 1:
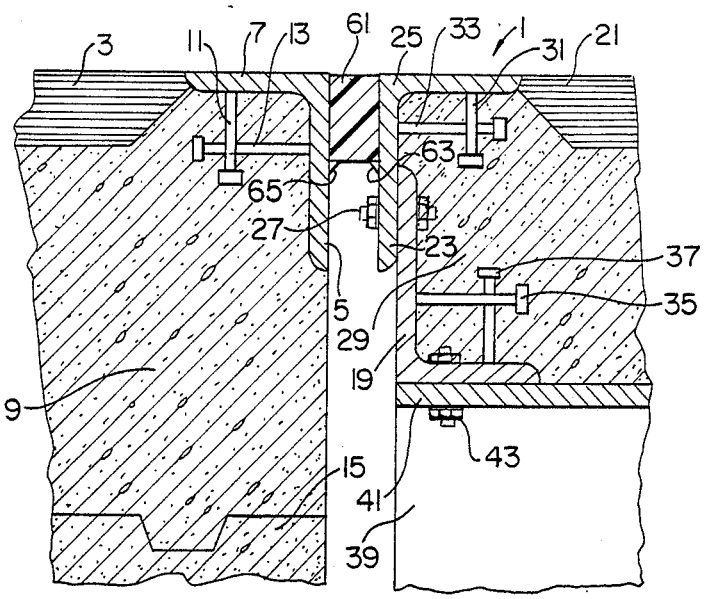
FIG. 1 PRIOR ART
FIG. 1 shows a side cut view of a typical prior art expansion joint from a starting section of a brid

Referring now to FIG. 1 there is shown generally an expansion joint assembly 1. A first road section 3 terminates with a vertical face 5 having a metal armor upper section 7 and a concrete lower section 9. In this particular embodiment, metal armor 7 is an angle iron, as shown, with vertical anchor 11 and horizontal anchor 13. These stud anchors are embedded in concrete 9 for stability. Roadway 3 is shown as a macadam topped roadway and has a substructure 15. Opposite first road section 3 is second road section 21 which terminates at vertical face 23 which is directly opposite vertical face 5 and, in this embodiment, has a metal armor upper section 25 and a lower section comprised of armor 19. Behind metal armor upper section 25 and armor 19, there is a concrete layer 29. Armor 25 is anchored to concrete 29 with stud anchors 31 and 33 and armor 19 is anchored to concrete 29 with stud anchors 35 and 37. Further, armor 25 and armor 19 are bolted together with nut and bolt assembly 27. In this particular embodiment shown in FIG. 1, the second road section 21 rests on I beam 39 having its horizontal top plate 41 anchored to armor 19 via nut and bolt assembly 43. Between first road section 3 and second road section 21 there is a neoprene elastomer strip 61 which rests on welded angle bars 63 and 65.

The arrangement shown in FIG. 1 is typical of prior art without the V-shaped or U-shaped channel assembly. That type of channel assembly is not shown because it is not conventional prior art and requires very special types of road or bridge section expansion joint members. Nonetheless, FIG. 1 does allow for thermal expansion and contraction of various members and, the typical arrangement shown in FIG. 1 having an I beam on one side, typifies a roadway termination at the beginning of a brideway.

Figure 2:
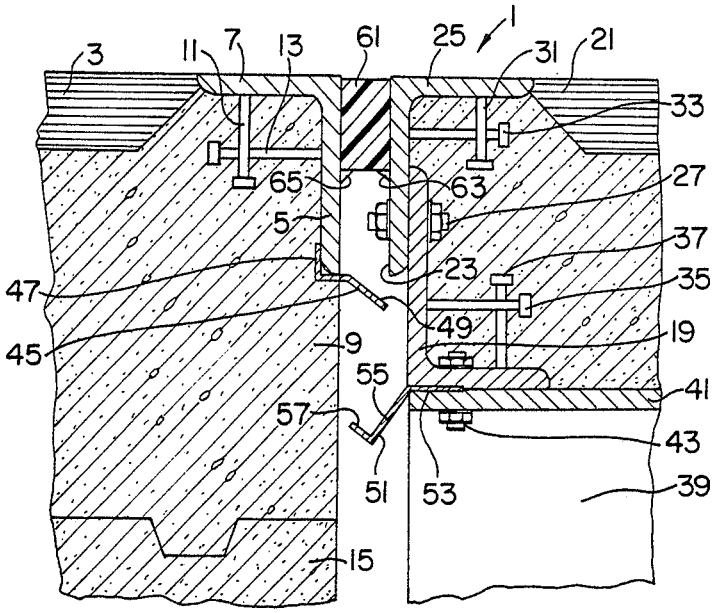
FIG. 2 shows the expansion joint of FIG. 1 modified so as to illustrate the expansion joint assembly of the present invention in one preferred embodiment.

Referring now to FIG. 2, like members shown in FIGS. 1 and 2 are like numbered. However, FIG. 2 represents the present invention and contains the aforesaid first road section 3 and second road section 21 as well as metal armor upper section 7 and metal armor upper section 25. First road section 3 has implanted in concrete 9, present invention deflector plate 45 which includes connecting surfaces 47 and deflecting surface 49. Water deflector plate 45 is embedded in concrete 9 just under and behind metal armor upper section 7 so that any water, acid rain or other liquid which seeps through the expansion joint at the vertical face 5 of first road section 3 will run down the metal armor and then run away from vertical face 5 down deflecting surface 49 of water deflector plate 45. In addition, water collector plate 51 is connected to second roadway 21 at the lower portion by being bolted through nut and bolt assembly 43 to metal armor 19 and I beam horizontal top plate 41. Water collector plate 51 includes connecting surface 53, an inner collecting surface 55 and an outer collecting surface 57. Inner collecting surface 55 runs downwardly and outwardly from connecting surface 53 and outer collecting surface 57 runs from the end of inner collecting surface 55 outwardly and upwardly, as shown. Thus, after the liquids run off deflecting surface 49 of water deflector plate 45, it runs down to water collector plate 51 and flows away from all of the concrete surfaces to protect them from contact and subsequent erosion or deterioration. As shown in FIG. 2, the water collector plate 51 is located below and under water deflector plate 45. As described, this is an important feature of the present invention as the arrangement prevents water from both sides to contact any concrete surfaces and yet the water deflector plate 45 does not touch any part of the second road section 21 nor does the water collector plate 51 touch any of the vertical face of first road section 3.

Figure 3:
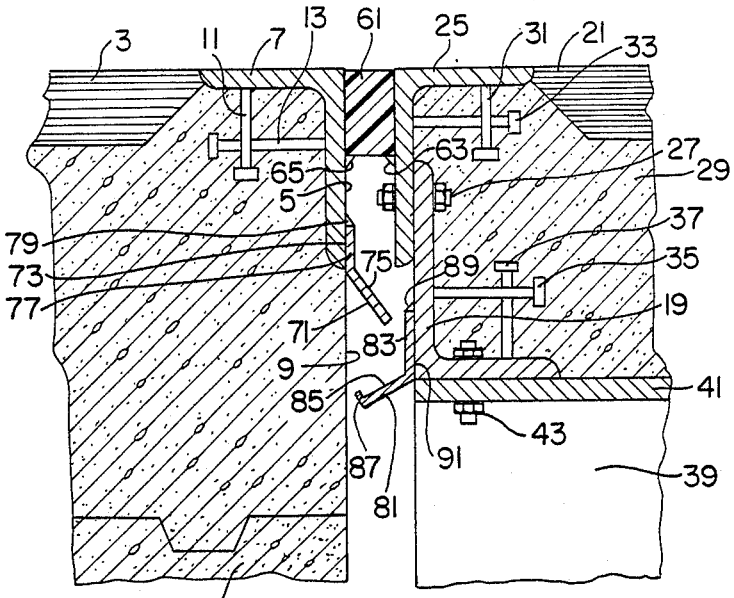
FIG. 3 represents an alternative present invention expansion joint assembly involving the type of prior art structure shown in FIG. 1.

FIG. 3 again shows the side cut view of the first road section 3 and second road section 21 and their components as set forth in FIG. 1 and like parts are like numbered.

However, in this particular embodiment, the deflector plate 71 has a connecting surface 77 which is welded at weld 73 and sealed at its top with caulking 79. Water deflector plate 71 includes deflecting surface 75. Also, water collector plate 81 includes connecting surface 83, inner collecting surface 85 and outer collecting surface 87 as shown. Here, water collector plate 81 is welded to armor 19 via weld 91 and has sealant 89 applied to the top thereof. Thus, in this particular embodiment, it can now be seen that water deflector plate 71 and water collector plate 81 could be pre-welded to the armor components or could be retrofitted to an existing expansion joint.

Figure 4:
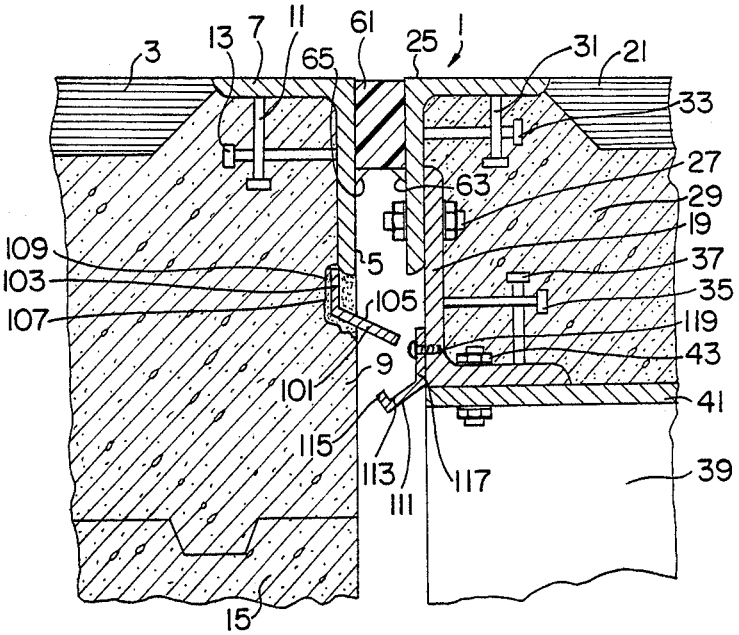
FIG. 4 shows a retrofitted expansion joint assembly of the present invention; and, FIG. 5 illustrates an alternative embodiment of the expansion joint assembly of the present invention which includes a drainpipe.

FIG. 4 again shows the particular expansion joint set forth in FIG. 1 and shows retrofitted water deflector plate 101 set into concrete 9. The space between armor 7 at its bottom most position and water deflector plate 101 is exaggerated to illustrate the invention. However, in realty, one would cut out groove 107 from concrete 9 and go up under the bottom of armor 7 and then insert water deflector plate 101 under armor 7 with connecting surface 103 ending up behind armor 7 and deflector surface 105 extending outwardly and downwardly therefrom. Concrete patch 109 would be filled into the groove to bond the water deflector plate 101 in place. As an alternative anchoring means, water collector plate 111 is shown having connecting surface 117, inner collecting surface 113 and outer collecting surface 115. At connecting surface 117, a hole is drilled therein as well as an armor 19 so as to enable screw 119 to secure water collector plate 111 thereto.

Figure 5:
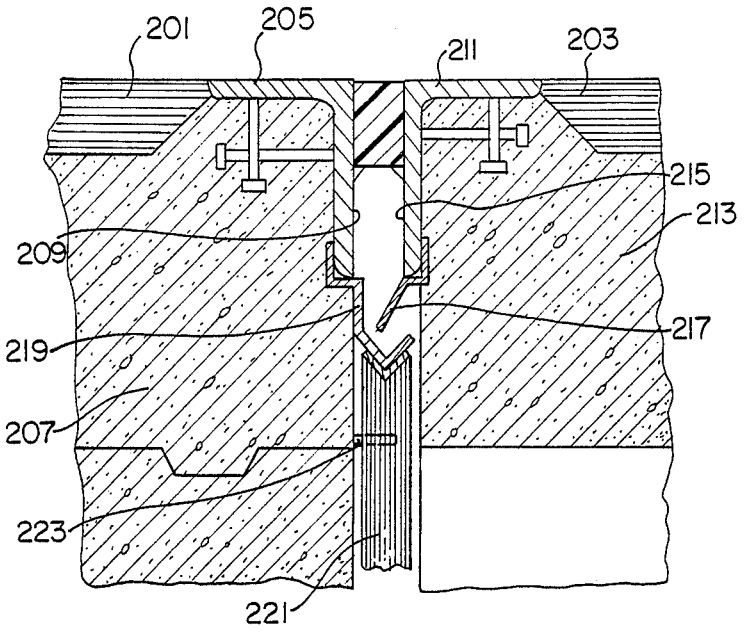

Referring now to FIG. 5 there is shown a first roadway section 201 and a second roadway section 203. First roadway section 201 contains armor 205 at its end thus forming along with the end of lower section concrete 207, a vertical face shown generally as 209. Likewise, second roadway section 203 has armor 211 along with the end of concrete 213 forming vertical face 215. Embedded in the concrete lower portions of vertical faces 215 and 209 respectively are water deflector plate 217 and water collector plate 219. Downspout 221 is also shown and this is connected to concrete 207 via strap 223. This embodiment illustrates that both the water deflector plate and the water collector plate may be formed in situ during the construction of expansion assemblies involving upper sections of armor and lower sections of concrete and to further illustrate the use of a downspout in conjunction therewith.

Obviously, numerous modifications and variations of the present invention are possible in light of the above teachings. For example, a typical expansion joint may have an elastomer seal strip, no seal, a metal sliding plate or a grid and still fall within the purview of the present invention. Also, in less preferred embodiments, one or both of the plates may be below a concrete deck, e.g. attached at an I beam below it. In cases where some concrete remains exposed above the water deflector plate and/or water collector plate, epoxy sealer may be applied to those areas and used in conjunction with the present invention. Thus, it is therefore understood that within the scope of the appended claims, the invention may be practiced otherwise than as specifically described herein.

What is claimed is:

1. An expansion joint assembly for roadways, bridgeways or parking garages comprising:

(a) a first road section terminating with a vertical face having a metal armor upper section and a concrete lower section;

(b) a second road section contiguous to said first road section and having a vertical face which is directly opposite the vertical face of said first road section, said second road section vertical face also having a metal armor upper section and having a lower section;

(c) a water deflector plate connected to the vertical face of either said first road section or said sec d road section, said deflector plate having a connecting surface which is an .ored to said vertical face and having a deflecting surface which tapers outwardly an downwardly from said vertical face with contacting the other vertical face of said first and second road section:

(d) a water collector plate connected to the vertical face of the other of said first and second road sec-&ions, said water collector plate having a connecting surface which is anchored to said vertical face and having an inner collecting surface and an outer collecting surface, the inner collecting surface running from said connecting surface outwardly and downwardly to said outer collecting surface, said outer collecting surface running from said inner collecting surface outwardly and upwardly and terminating below said deflector plate and under it without contacting said deflector plate or the vertical face to which it is connected;

(e) anchoring means connecting said deflector plate to said vertical face; and, (f) anchoring means connecting said collecting plate to said vertical face.

2. The expansion joint assembly of claim 1 wherein said deflector plate is connected to said vertical face by bolt type anchoring means by being bolted to said metal armor.

3. The expansion joint assembly of claim 2 wherein the connecting surface of said deflector plate is bolted behind a position of metal armor.

4. The expansion assembly, of claim 1 wherein said collector plate is connected to said vertical face by bolt type and boring means by being bolted to said metal armor.

5. The expansion joint assembly of claim 4 wherein the connecting surface of said collector plate is bolted behind a portion of metal armor.

6. The expansion joint assembly of claim 1 wherein said deflector plate and said collector plate are connected to said metal armor by being welded thereto and the weld is the anchoring means.

7. The expansion joint assembly of claim 1 wherein said deflector plate is attached to said vertical face by being fitted under said metal armor atop said concrete during construction and the weight of the metal armor and the bonding of the concrete are the anchoring means.

8. The expansion joint assembly of claim 1 wherein said collector plate is attached to said vertical face by being fitted under said metal armor atop said concrete during construction and the weight of the metal armor and the bonding of the concrete are the anchoring means.

9. The expansion joint assembly of claim 1 wherein said deflector plate and said collector plate are connected to said vertical faces after said vertical faces have been constructed, by each being embedded into a cut made in the concrete of the vertical faces and wherein concrete bonding is applied in place to the plates as the anchoring means.

10. The expansion joint assembly of claim 1 further comprising an elastomeric spacer block being located at the upper portion of the vertical faces of said first road section and said second road section.

11. The expansion joint assembly of claim 1 which further includes a downspout at one end of said collector plate so as to control the runoff emitting therefrom.

12. A method of improving drainage and protecting concrete portions of an expansion joint assembly bridgeways or parking garages, which includes a first road section terminating With a vertical face having a metal armor upper section and a concrete lower section and a second road section contiguous to said first road section and having a vertical face which is directly opposite the vertical face of said first road section, said second road section vertical face also having a metal armor upper section and having a lower section, which comprises:

(a) attaching a water deflector plate to the vertical face of one of said first road section and said second road section, said deflector plate being connected to the vertical face by anchoring means, said deflector plate also having a deflecting surface which tapers outwardly and down wardly from said vertical face without contacting the opposite vertical face; and, (b) attaching a water collector plate to a vertical face of the other of said first road section and said second road section, said water collecting plate having a connecting surface which is anchored to said vertical face and having an inner collecting surface and an outer collecting surface, the inner collecting surface running from said connecting surface outwardly and downwardly to said outer collecting surface, said outer collecting surface running from said inner collecting surface outwardly and upwardly and terminating below said deflector plate and under it without contacting said deflector plate or the vertical face opposite to it.

13. The method of claim 12 wherein said water deflector plate is anchored to said vertical face at the metal armor by being welded thereto.

14. The method of claim 12 wherein said water collector plate is anchored to said vertical face by being welded to the metal armor of said vertical face.

15. The method of claim 12 wherein at least one of said concrete lower sections is cut out to form a groove and the connecting surface of either the water collector plate or the water deflector plate is inserted into said groove and bonded thereto.

16. The method of claim 15 wherein said bonding is accomplished by application of a concrete bonding agent.

17. The method of claim 12 wherein the metal armor sections of said vertical faces are drilled and the water deflector plate and the water collector plate are screwed onto the armor of said vertical faces and a sealing caulk is subsequently applied to form a seal at the deflector plate and the collector plate to prevent water and other liquids from running down said vertical faces behind each of said water deflector plate and water collector plate.

* * * * *